US005419386A

United States Patent [19]

Magro et al.

[11] Patent Number: 5,419,386

[45] Date of Patent: May 30, 1995

[54] INSULATED ROLL-UP DOOR PROVIDED WITH METAL OUTER AND INNER WALLS

[76] Inventors: Sebastian Magro, 22 Hallock Meadow Dr. North; Vincent Magro, 44 Melvern La., both of Stonybrook, N.Y. 11790

[21] Appl. No.: 206,617

[22] Filed: Mar. 7, 1994

[51] Int. Cl.[6] ..... E06B 9/10

[52] U.S. Cl. ..... 160/232; 160/41; 160/236

[58] Field of Search ..... 160/232, 235, 236, 133, 160/32, 41, 230

[56] References Cited

U.S. PATENT DOCUMENTS

| | | | |
|---|---|---|---|
| 3,234,996 | 2/1966 | King et al. | 160/232 X |
| 3,967,671 | 7/1976 | Stanley et al. | 160/201 X |
| 4,173,247 | 11/1979 | Piana | 160/236 |
| 4,436,136 | 3/1984 | Downey | 160/232 |
| 4,601,953 | 7/1986 | Haffer | 160/232 X |
| 4,628,982 | 12/1986 | Labelle | 160/232 X |
| 4,630,664 | 12/1986 | Magro | 160/232 |
| 4,972,894 | 11/1990 | Machill | 160/235 |
| 4,979,553 | 12/1990 | Lowry et al. | 160/232 X |
| 5,322,108 | 6/1994 | Hoffman | 160/235 X |
| 5,365,990 | 11/1994 | Ueda | 160/236 X |

*Primary Examiner*—David M. Purol

*Attorney, Agent, or Firm*—Goodman & Teitelbaum

[57] ABSTRACT

A roll-up door having a plurality of elongated adjoining metal slats hinged together to permit the slats to be arcuately pivoted when being rolled up, an elongated plastic insulation member being coextensively inserted along each slat, and a metal inner rear wall being coextensively inserted along each insulation member so that each insulation member is sandwiched therebetween. Each assembled insulation member and inner rear wall is provided with a coupling arrangement for engaging the hinges of the connected slats, and a snap-in arrangement for securing the inner rear wall to the insulation member. Each inner rear wall also has a first hook portion disposed around an associated second hook portion on the insulation member, the first hook portion having a flange which snaps onto a longitudinal free edge of the second hook portion for securement therebetween. Longitudinal recesses are provided on each inner rear wall for engagement in associated longitudinal recesses provided in each insulation member. In an embodiment, the insulation member is provided with sealing fins projecting therefrom. In another embodiment, numerous perforations are provided through the web portions of the slats, and an elongated fabric material is disposed between the slats and the adjacent insulation members.

20 Claims, 3 Drawing Sheets

INSULATED ROLL-UP DOOR PROVIDED WITH METAL OUTER AND INNER WALLS

BACKGROUND OF INVENTION

This invention relates to a roll-up door and, more particularly, to a roll-up door having insulating means disposed between the metal outer and inner walls thereof, where the metal inner rear wall is insertable onto a plastic insulation member provided on each metal front wall slat of the door.

Roll-up doors are usually utilized in connection with store fronts, garages and trucks. Typically, such roll-up doors include a series of adjoining slats which are hingedly interconnected, so that the slats can be pivoted with respect to each other about the connecting hinges when the door is moved from its vertically closed position into its raised rolled up position. Generally, the roll-up door is provided with some form of insulation to prevent heat loss from within the store, garage or truck. Such insulation is usually added to the door slats after the door has been assembled, where the insulation can be of the foam type which is sprayed on or applied in block form. In many cases, the slats are formed with hollow recesses therein to receive such insulation.

A prior insulated roll-up door is disclosed in U.S. Pat. No. 4,630,664, the roll-up door being formed of a plurality of elongated adjoining slats connected together by hinges to permit the door to be rolled up along an arcuate track arrangement for storage thereof when in an opened position. Elongated plastic insulating hollow members or sleeves are coextensively inserted along the rear portion of each slat for receiving insulation material therein.

The present invention is directed to an improvement of the insulated roll-up door disclosed in U.S. Pat. No. 4,630,664. Accordingly, there is presently a need to provide a metal inner rear wall on the plastic insulating hollow members disclosed in this patent in order to protect the plastic insulating hollow members, to improve the insulation of the roll-up door and to improve the decorative appearance of the interior wall of the roll-up door. Furthermore, there is also a need to provide sealing means between the slat hinges and the plastic insulating hollow members to prevent air, water, snow, moisture and the like from passing therebetween, where the sealing means can also function to reduce the amount of sound passing therethrough. Additionally, there is also a need to provide dampening means in the slats of the door to reduce or prevent outside sound from passing through the door.

SUMMARY OF THE INVENTION

Accordingly, an object of the present invention is to provide a roll-up door which avoids the problems of the prior art roll-up doors.

Another object of the present invention is to provide a roll-up door having plastic insulation members disposed along metal slats of the roll-up door, and metal inner rear walls disposed on each of the plastic insulation members.

Another object of the present invention is to provide a roll-up door which can be assembled from individual slats, insulation members and inner rear walls, which are coextensively sandwiched together.

A further object of the present invention is to provide a roll-up door in which the insulation members include hollow sleeves for receiving insulation therein.

Still another object of the present invention is to provide a roll-up door in which each inner rear wall snap-fits onto an associated insulation member, which in turn snap-fits into an associated slat.

Yet another object of the present invention is to provide a snap-in portion on each inner rear wall for inserting into a receptacle portion provided in a rear wall of an associated insulation member.

Another object of the present invention is to provide a roll-up door in which sealing means are provided between the slat hinges and the plastic insulation members to prevent air, water, snow, moisture and the like from passing therebetween, the sealing means being longitudinally extending, spaced apart resilient sealing fins extending outwardly from the walls of the plastic insulation members.

A further object of the present invention is to provide a roll-up door in which dampening means are provided in the slats of the door to reduce or prevent outside sound from passing through the door, the dampening means including numerous perforations provided through the web portions of the slats and/or an elongated fabric material, such as plastic, rubber, cloth and the like, disposed between inner surfaces of the slats and the adjacent walls of the plastic insulation members.

Briefly, in accordance with the present invention, there is provided a roll-up door having a plurality of elongated adjoining metal slats, with adjacent slats being hinged together to permit the slats to be arcuately pivoted with respect to each other when the door is being rolled up into an opened position. An elongated plastic insulation member is coextensively inserted along each slat, where the insulation member includes a hollow sleeve to provide a hollow chamber therethrough to receive insulation therein. A metal inner rear wall is coextensively inserted along the rear wall of each insulation member so that each insulation member is sandwiched between the metal outer slat and the metal inner rear wall. On opposing sides of each assembled insulation member and inner rear wall, there are provided coupling arrangements for engaging the hinges of the connected slats, where the coupling arrangements permit the slats to pivot with respect to each other.

Each inner rear wall is provided with a snap-in portion which is received in a receptacle portion provided in the rear wall on each insulation member to secure the inner rear wall and the insulation member together. Each inner rear wall includes a resilient lip portion disposed against an associated resilient lip portion of each insulation member for securement thereto. On an opposite side, each inner rear wall is provided with a hook portion which is disposed around an associated hook portion on the insulation member, where the hook portion of the inner rear wall is provided with a flange which snaps onto a longitudinal free edge of the hook portion of the insulation member to provide securement therebetween. Longitudinal recesses are provided on each inner rear wall for engagement in associated longitudinal recesses provided in the rear wall of each insulation member so that the inner rear wall is securely fixed against an outer surface of the rear wall of the insulation member.

In an embodiment of the present invention, sealing means are provided between the slat hinges and the plastic insulation members to prevent air, water, snow, moisture and the like from passing therebetween, the sealing means preferably being longitudinally extending, spaced apart resilient sealing fins extending outwardly from the walls of the plastic insulation hollow members. In another embodiment, dampening means are provided in the slats of the door to reduce or prevent outside sound from passing through the door, the dampening means preferably including numerous perforations provided through the web portions of the slats and/or an elongated fabric material such as plastic, rubber, cloth and the like, disposed between inner surfaces of the slats and the adjacent walls of the plastic insulation members.

BRIEF DESCRIPTION OF THE DRAWINGS

With the above and additional objects and advantages in view, as will hereinafter appear, this invention comprises the devices, combinations and arrangements of the parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
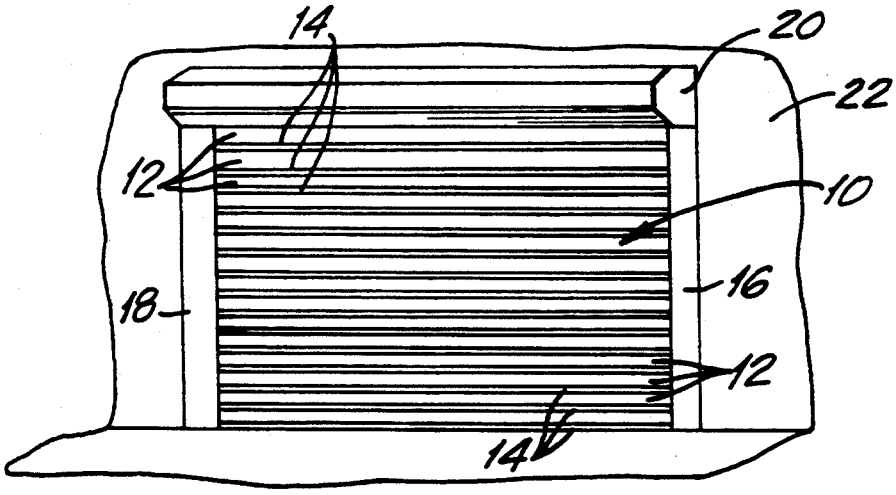
FIG. 1 is a front perspective view of a roll-up door.

Referring now to the drawings, FIG. 1 generally shows a roll-up door 10 including a plurality of individually elongated slats 12 extending the width of the door 10. The slats 12 are interconnected by a hinge arrangement 14, which connects the adjacent slats 12 together while permitting pivotal movement therebetween. The ends of the slats 12 are protected by side guard rails 16, 18, which contain conventional track arrangements therein along which the slats 12 can ride. At the upper end, there is provided a projecting conventional header 20, which contains the necessary mechanism for raising or lowering the door 10, which is well known in the roll-up door art.

The roll-up door 10 can typically be the front of a store 22, a garage, a truck or the like. In the closed position, the slats 12 provide a vertical coplanar arrangement for closing the store 22. In order to open the door 10, the door 10 is rolled upward so that each of the slats 12 pivot arcuately, with respect to the adjoining slat 12, around a conventional support roller disposed in the header 20. Within the header 20, the slats 12 run along arcuate tracks for storage in a substantially horizontal position on the support roller in a conventional manner well known in the art.

Figure 2:
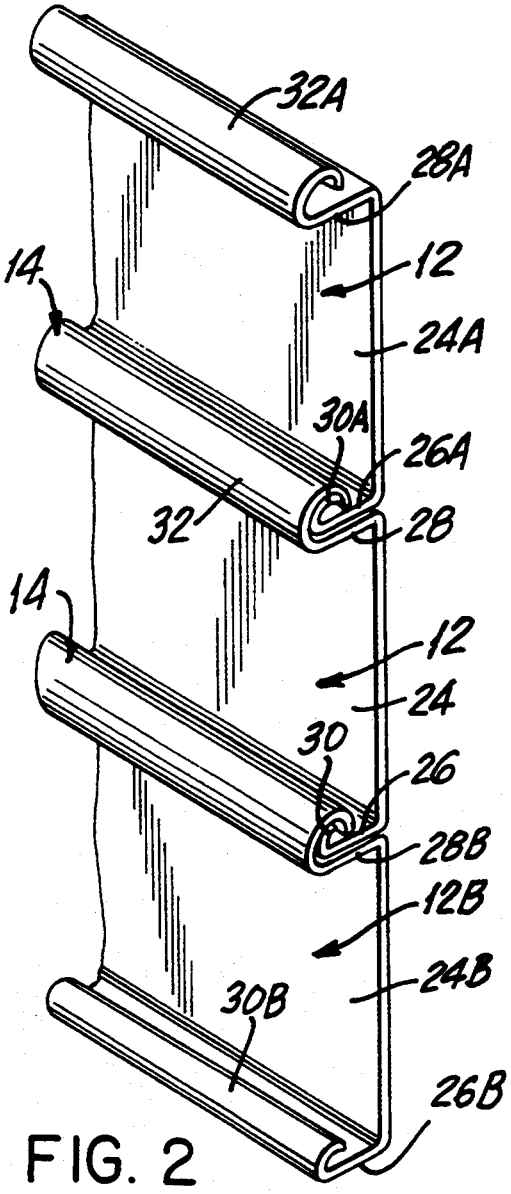
FIG. 2 is a fragmented perspective view of interconnected slats forming the outer front wall of the door.

As shown in FIG. 2, each of the slats 12 is formed of a substantially U-shaped metal channel, including a web portion 24 interconnecting outwardly directed flanges 26, 28. The outer surface of the web portion 24, together with all the other corresponding web outer surfaces, constitutes the outer front wall of the roll-up door 10.

At the distal edge of the flange 26, there is provided an inwardly turned arcuate segment 30 directed forwardly towards the web portion 24. It is noted, that the arcuate segment 30 runs the entire longitudinal length of the slat 12 and, accordingly, extends the entire width of the roll-up door 10. The forwardly directed portion of the arcuate segment 30 extends only part way along the flange 26.

At the distal edge of the opposite flange 28, there is likewise provided an inwardly turned arcuate segment 32 directed forwardly towards the web portion 24. Likewise, the arcuate segment 32 runs the entire length of the slat 12 and, accordingly, extends the width of the roll-up door 10. The arcuate segment 32 also only extends forwardly along a portion of the flange 28.

Both arcuate segments 30 and 32 are substantially identically curved. However, the arcuate segment 30 has a smaller diameter than does the arcuate segment 32. Thus, the arcuate segment 30 of one slat 12 can fit within the arcuate segment 32 of an adjacent slat 12, and can rotate therein, as set forth below.

It should be appreciated, that each of the slats of the roll-up door 10 has a configuration corresponding to the hereto described slat 12. For convenience, the adjoining slat vertically above the slat 12 is designated as slat 12A, and the corresponding parts of slat 12A are identified with the subscript A. Similarly, the other adjoining slat vertically below the slat 12 is designated as slat 12B, and the corresponding parts of slat 12B are designated with the additional subscript B.

Accordingly, on the one hand, each of the smaller diameter arcuate segments 30, 30A, 30B . . . defines a hinge pin arrangement. On the other hand, all the larger arcuate segments 32, 32A, 32B . . . constitute a hinge barrel arrangement. In this manner, the hinge pin of one slat slides into the hinge barrel of the adjoining slat, as set forth below in more detail.

More specifically, as shown in FIG. 2, the arcuate segment 30 of the slat 12, which now constitutes a hinge pin 30, slides into the arcuate segment 32B of the next adjacent lower slat 12B, which now constitutes a hinge barrel 32B. Similarly, the arcuate section 32 of the slat 12, which now constitutes a hinge barrel 32, receives therein the arcuate segment 30A of the next adjoining upper slat 12A on the other side thereof, which now constitutes a hinge pin 30A. In this manner, all the slats can be hingedly connected to each other by means of the integral hinge arrangement.

Accordingly, the slats are individually formed and can be assembled together in the above manner to provide the desired height of a particular roll-up door 10 by means of interconnecting the desired number of slats. Similarly, the width of the roll-up door 10 can be provided by properly selecting the length of each slat to extend horizontally across the front of the store 22 or opening to be closingly covered.

The integral hinge arrangement mentioned above permits pivotal rotation of adjoining slats so that they can move from a vertically coplanar position, as shown in FIG. 2, to a rolled up position on the support roller as the roll-up door 10 moves along the track arrangements from a closed position to an opened position.

Figure 3:
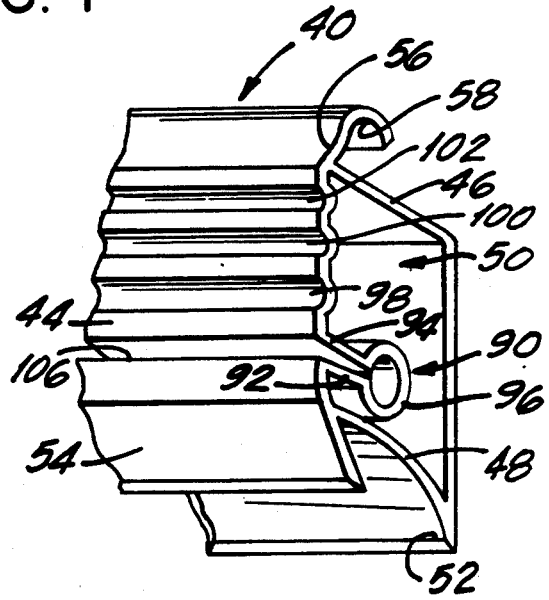
FIG. 3 is a fragmented perspective view of a plastic insulation member for each slat.

Preferably, insulation is provided against the inner surface of the slats, such as sprayed on foam insulation, strips of foam insulation secured by fastening means, and the like. FIG. 3 shows a plastic insulation insert or member 40 which is utilized for coextensive insulation against each individual slat. Preferably, the insulation member 40 is filled with insulation to provide for the necessary insulation of each slat, and can be assembled with the slats, as set forth below.

The insulation member 40 is a substantially hollow sleeve having a front wall 42, a rear wall 44, and opposing side walls 46, 48. The hollow chamber 50 formed therethrough preferably receives insulation of various types, for example, foam insulation, solid insulation, or other types of insulation including air. It is noted, that the length of the insulation member 40 corresponds substantially to the length of each slat 12 and, accordingly, extends the entire longitudinal width of the roll-up door 10.

At the lower part of the front wall 42, the insulation member 40 includes a downwardly extending foot portion 52. The lower side wall 48 is formed with an arcuate curvature which extends inwardly in a rearward direction from the foot portion 52 to the rear wall 44. On the lower portion of the rear wall 44, there is provided a cantilevered lip portion 54, which extends outwardly from the arcuate side wall 48 in a forwardly inclined direction to be disposed in a spaced position over the foot portion 52. The lip portion 54 is resilient, the function of which is set forth below. The upper portion of the rear wall 44 terminates in a concave portion 56, which bends into an arcuate inwardly curved hook portion 58. The hook portion 58 extends forwardly part way towards the front wall 42 in a spaced apart arrangement from the upper side wall 46.

Typically, the entire insulation member 40 can be formed of plastic material and integrally molded as a one piece construction. Accordingly, the resiliencey of the lip portion 54 is provided by the plastic material and the cantilevered construction thereof.

The construction described above, except for the inclining of the lip portion 54, is substantially set forth in the above-mentioned U.S. Pat. No. 4,630,664. Pursuant to the present invention, the rear wall 44 has been modified to receive a metal inner rear wall for each slat 12, as will be described below.

Figure 4:
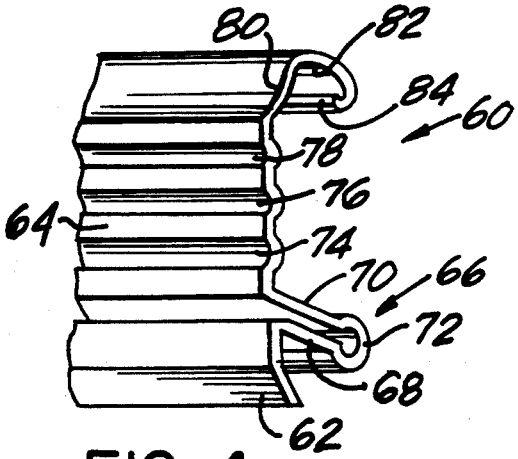
FIG. 4 is a fragmented perspective view of a metal inner rear wall for each slat.

FIG. 4 shows a metal inner rear wall 60, preferably fabricated from a galvanized steel, in accordance with the present invention, in order to protect the plastic insulation member 40, to improve the insulation of the roll-up door 10 and to improve the decorative appearance of the interior wall of the roll-up door 10. The inner rear wall 60 is inserted against the rear wall 44 of the insulation member 40, as set forth below. It is noted, that the length of the inner rear wall 60 corresponds substantially to the length of the slats 12 and the insulation members 40 and, accordingly, extends the entire interior width of the roll-up door 10.

Adjacent the inclined lip portion 62 of the inner rear wall 60 is a resilient snap-in portion 66 extending forwardly from the body 64 thereof. The snap-in portion 66 includes two spaced apart legs 68, 70 extending perpendicularly from the body 64. An enlarged arcuately curved resilient portion 72 connects the opposite forward ends of the legs 68, 70 together, the curved portion 72 having a bubble-like configuration. Accordingly, the resiliency of the curved portion 72 permits the longitudinally extending sides thereof to be squeezed together when being inserted during the snapping-in thereof, as set forth below.

Above the snap-in portion 66, there are provided preferably three spaced apart recesses 74, 76 and 78 or corrugations extending longitudinally across the body 64, the function of which will be set forth below. The upper longitudinal portion of the body 64 terminates in a concave portion 80, which bends into an arcuate inwardly curved convex hook portion 82. The free end of the hook portion 82 is turned inwardly to provide a longitudinally extending flange 84.

As mentioned above, the rear wall 44 of the insulation member 40 of FIG. 3 is modified to receive the inner rear wall 60. Accordingly, adjacent the cantilevered lip portion 54, a receptacle portion 90 extends forwardly into the hollow chamber 50 to receive the snap-in portion 66 of the inner rear wall 60 therein, as set forth below.

The receptacle portion 90 includes two forwardly extending legs 92, 94, which are spaced apart a predetermined distance substantially equal to the distance between the outer walls of the legs 68, 70 of the snap-in portion 66 of the inner rear wall 60. The legs 92, 94 extend perpendicularly from the rear wall 44. An arcuately curved portion 96 connects the forward ends of the legs 92, 94 together, where the arcuately curved portion 96 is sized to receive the arcuately curved resilient portion 72 of the snap-in portion 66 therein, as set forth below.

Above the receptacle portion 90, there are provided preferably three spaced apart recesses 98, 100 and 102 or corrugations, extending longitudinally across the rear wall 44. The recesses 98, 100 and 102 receive the recesses 74, 76 and 78 of the inner rear wall 60 therein, respectively, as set forth below.

Figure 6:
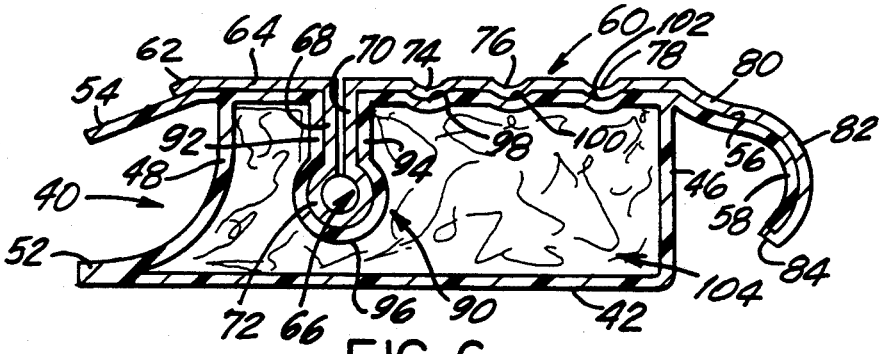
FIG. 6 is a side elevational view, in cross section, showing the metal inner rear wall mounted on the plastic insulation member.
Figure 5:
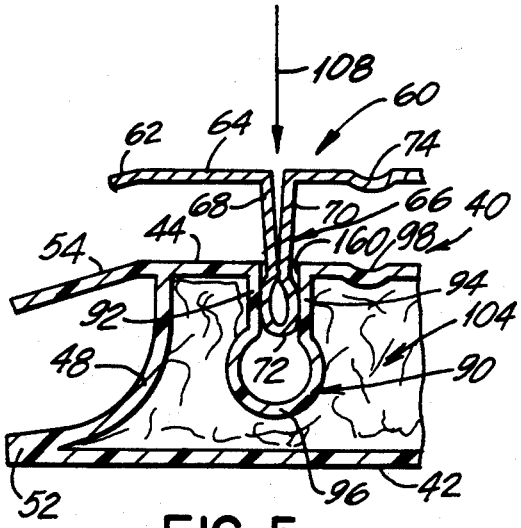
FIG. 5 is a fragmented side elevational view, in cross section, showing the metal inner rear wall being inserted onto the plastic insulation member.

The inner rear wall 60 is inserted onto the insulation member 40, as shown in FIGS. 5 and 6, to provide an integral arrangement thereof. However, it is noted, that a suitable insulation material 104 can be inserted within the hollow chamber 50 of the insulation member 40 before or after the inner wall 60 and the insert 40 are attached together, or in some cases, the insulation material 104 is not required.

As shown in FIG. 5, the inner rear wall 60 is aligned with the insulation member 40 so that the curved resilient portion 72 of the snap-in portion 66 of the inner rear wall 60 is at the mouth 106 of the receptacle portion 90 of the insulation member 40. The inner rear wall 60 is then pushed towards the insulation member 40 in the direction of arrow 108 so that the curved portion 72 enters into the receptacle portion 90. Accordingly, the legs 92, 94 of the receptacle portion 90 squeeze the sides of the curved resilient portion 72 of the snap-in portion 66 together so that the curved resilient portion 72 passes between the legs 92, 94. It is noted, that the legs 68, 70 of the snap-in portion 66 are also squeezed together, as shown in FIG. 5. Once the curved resilient portion 72 passes the legs 92, 94 and enters into the curved portion 96 of the insulation member 40, the curved resilient portion 72 expands and snaps against the inner walls of the curved portion 96 to secure the snap-in portion 66 within the receptacle portion 90, as shown in FIG. 6.

Accordingly, when the snap-in portion 66 of the inner rear wall 60 is secured within the receptacle portion 90, the lip portion 62 of the inner rear wall 60 is resiliently disposed against the upper portion of the lip portion 54 for securement thereto. The portion of the inner rear wall 60 between the lip portion 62 and the snap-in portion 66 is thus secured against the corresponding portion on the rear wall 44 of the insulation member 40.

The hook portion 82 of the rear wall 60 is now disposed around the hook portion 58 of the insulation member 40, and the flange 84 of the inner rear wall 60 is snapped onto the longitudinal free edge of the hook portion 58 to secure same together, where the concave portion 80 of the inner rear wall 60 abuts against the concave portion 56 of the insulation member 40. Additionally, the longitudinal recesses 74, 76 and 78 of the inner rear wall 60, if not already positioned, are snapped into their respective associated recesses 98, 100 and 102 of the insulation member 40 so that the inner rear wall 60 is securely fixed against the outer surface of the rear wall 44 of the insulation member 40, as shown in FIG. 6.

It is noted, that instead of the preferred above-snap-in attachment of the inner rear wall 60, the inner rear wall 60 can be attached to the insulation member 40 by a sliding engagement therebetween. In the sliding engagement, the lip portion 62, the snap-in portion 66, the recesses 74, 76, 78, the concave portion 80, the hook portion 82 and the flange 84 on one end of the inner rear wall 60 are aligned with the lip portion 54, the receptacle portion 90, the recesses 98, 100, 102, the concave portion 56, the hook portion 58 and the free end of the hook portion 58 at an end of the rear wall 44 of the insulation member 40, respectively. The inner rear wall 60 is then slid across the entire longitudinal length of the rear wall 44 of the insulation member 40 to slidingly engage the inner rear wall 60 to the insulation member 40, as shown in FIG. 6, which achieves the same result as if the inner rear wall 60 was snapped onto the rear wall 44 of the insulation member 40, as described above.

It is further noted, that instead of the snap-in portion 66 and the receptacle portion 90 extending the entire longitudinal length of the inner rear wall 60 and the insulation member 40, respectively, there can be provided a series of spaced apart snap-in portions disposed longitudinally along the inner rear wall 60, and a series of corresponding spaced apart receptacle portions disposed longitudinally along the rear wall 44 of the insulation member 40 to matingly receive the corresponding snap-in portions therein.

Figure 7:
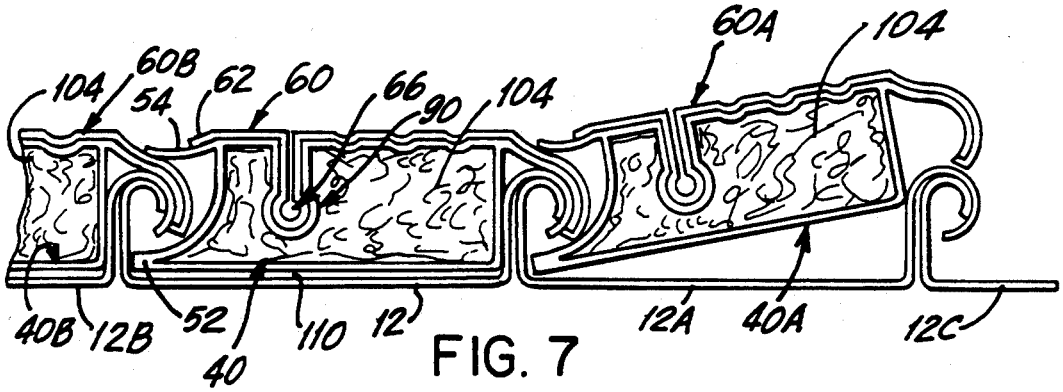
FIG. 7 is a fragmented side elevational view, showing the positioning of the combined inner rear wall and insulation member arrangements on associated slats.
Figure 8:
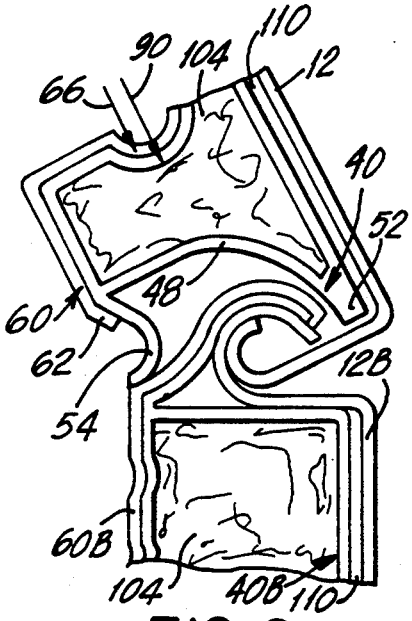
FIG. 8 is a fragmented side elevational view, showing the hinged rotation of adjacent slats having the combined inner rear wall and insulation member arrangements thereon.

Referring now to FIGS. 7 and 8, there is shown three insulation members 40, 40A, 40B having the inner rear walls 60, 60A, 60B already connected thereto, respectively, installed or being installed on the three slats 12, 12A, 12B shown in FIG. 2. The insulation member 40 with the inner rear wall 60 thereon is shown already installed in place on the slat 12. Accordingly, the foot portion 52 is wedged against the flange 26 beneath the hinge connection including the hinge pin 30 of the slat 12 and the hinge barrel 32B of the adjoining slat 12B. The lip portion 54 overlies the hinge connection 30, 32B as well as the hook portion 58B and the hook portion 82B of the adjoining insulation member 40B and inner rear wall 60B, respectively. The lip portion 54 is disposed in a resilient pressing engagement against the concave portion 80B of the adjoining inner rear wall 60B. At the opposite upper end, the hook portion 58 with the hook portion 82 thereon overlies the entire hinge connection 32, 30A at the opposite end of the slat 12, and concave portion 80 receives thereon the lip portion 54A of the adjoining insulation member 40A.

It is noted, that the insulation member 40 can be assembled by sliding the insulation member 40 along the slat 12 until it is coextensive with the longitudinal length of the slat 12. Alternatively, the insulation member 40 can be positioned by a snap-in assembly thereof, as indicated in FIG. 7. Accordingly, the foot portion 52A is first wedged in place adjacent the flange 26A, and then the hook portion 58A with the hook portion 82A thereon is snapped over the hinge connection 32A, 30C at the other end of the slat 12A.

The arcuate wall 48 of the insulation members 40 forms a recess for receiving the hinge arrangement which couples the adjoining slats together, and for also receiving the hook portions of the adjoining insulation member and inner rear wall. By means of the arcuate recessed wall 48, the adjoining slats can be pivoted during the opening and closing of the door, as shown in FIG. 8. During this pivoting movement, the resilient lip portion 54 flexes to permit the pivotal movement of the slats with respect to each other, while resiliently abutting against the concave portion of the adjoining inner rear wall to maintain the position of the adjacent insulation members and inner rear walls within their corresponding slats.

It is noted, that the insulation member 40 does not cover the entire depth of the channel of the slat 12. Thus, the front wall 42 of the insulation member 40 is spaced from the web portion 24 of the slat 12 to provide an air space 110 therebetween. This air space 110 provides additional insulation for the door 10. It is noted, that the lip portion 54 at one end and the hinge portion 58 at the other end of the insulation member 40 maintain the front wall 42 in the spaced position to provide the air space 110.

It is further noted, that if it is necessary to retain the insulation members 40 longitudinally within the slats 12, stop means can be provided at the longitudinal ends of the web portions 24 of the slats 12, in the manner set forth in U.S. Pat. No. 4,630,664.

With the use of the above-mentioned insertable insulation members 40 and inner rear walls 60, it is possible to construct a roll-up door 10 by first assembling the slats 12 together to the desired length and width as required. The insulation members 40 combined with inner rear walls 60 can then be either slid in place within the slats 12 or snap-fit in place as mentioned above, and proper stop means can be used if required to retain the insulation members 40 longitudinally within the slats 12. The insulation members 40, as well as the inner rear walls 60, can also be removed when desired by either sliding them out or unsnapping them out.

Furthermore, although the insulation member and inner rear wall are provided coextensively within each slat, it should be appreciated that the use of the insulation members and inner rear walls in no way at all interferes with the pivotal operation of the slats, in which the slats can continue to be moved between the closed position in which the slats constitute a vertical planar arrangement, and the opened position where the slats run along the tracks and are rolled up on the support roller within the header 20 for storage therein.

Figure 9:
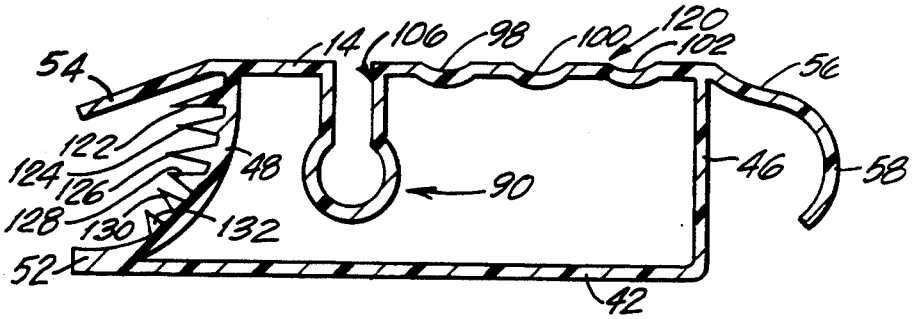
FIG. 9 is a side elevational view, in cross section, showing a modification of the plastic insulation member provided with sealing means projecting from a wall thereof.

Referring now to FIG. 9, a modified insulation member 120 is shown which is substantially the same as the above-mentioned insulation member 40, except the insulation member 120 is provided with longitudinally extending, spaced apart sealing fins 122,124, 126, 128, 130 and 132 on the lower side wall 48 thereof. The sealing fins 122–132 are preferably fabricated from a soft rubber, being secured to or formed on the lower side wall 48 during the molding or extrusion thereof, where the walls of the insulation member 120 are preferably fabricated from a hard plastic material.

Figure 11:
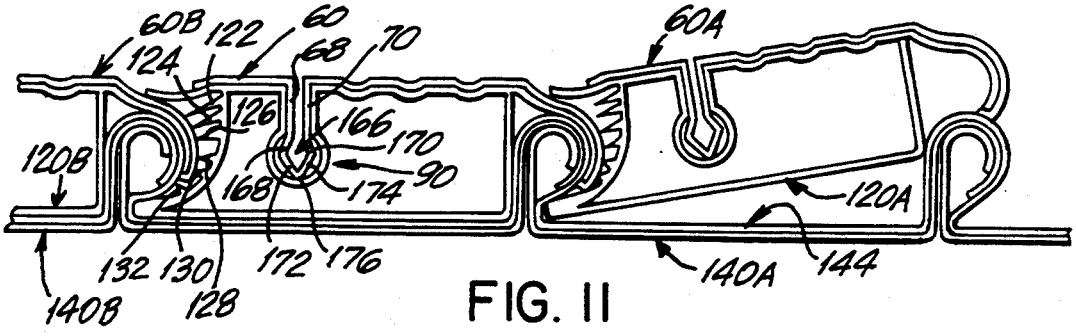
FIG. 11 is a fragmented side elevational view, similar to FIG. 7, showing the positioning of the inner rear wall and the modified insulation member of FIG. 9 with respect to the fabric material and modified slats of FIG. 10.

As shown, the sealing fins 122–132 extend outwardly in different lengths from the lower side wall 48, where the sealing fin 122 is the longest thereof, and the sealing fin 132 is the shortest thereof. As shown in FIG. 11, the sealing fins 122–132 fill the space between the lower side wall 48 and the hook portion 82B of the adjacent inner rear wall 60B which is disposed on the hook portion 58B of the adjacent insulation member 120B. Thus, the sealing fins 122–132 function as a barrier to prevent air, water, snow, moisture and the like, from passing therethrough. The sealing fins 120–132 will also reduce the amount of sound passing through the door 10. A further modification is set forth below to also prevent sound from passing through the door 10.

Figure 10:
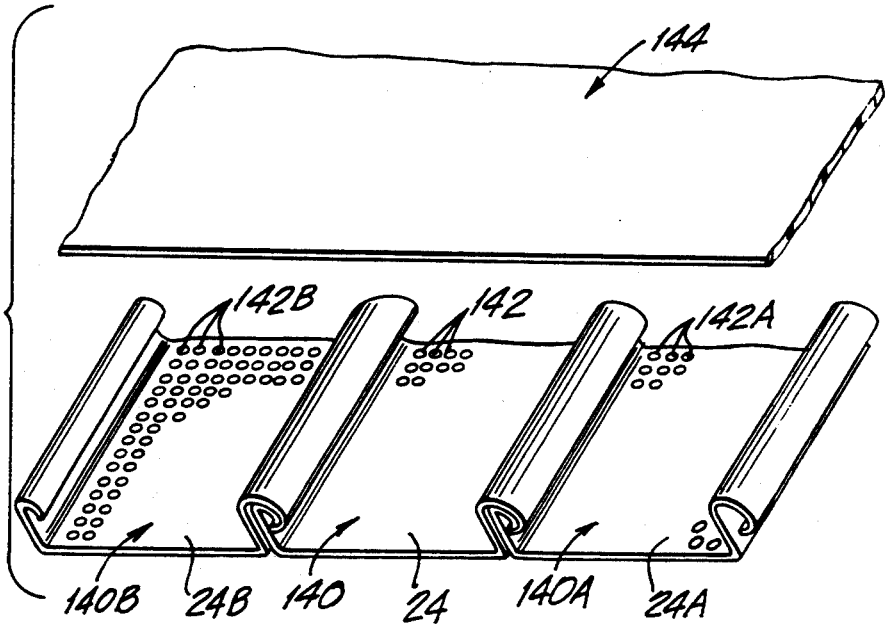
FIG. 10 is an exploded fragmented perspective view, showing modified slats provided with numerous perforations through the web portions thereof, and an associated fabric material which is disposable against the inner surfaces of the slats.

FIG. 10 shows modified slats 140, 140A, 140B which have the same construction and are connected together in the same manner as the above-mentioned slats 12, 12A, 12B described above and shown best in FIG. 2. However, the web portions 24, 24A, 24B thereof have been modified to include numerous perforations 142, 142A, 142B, respectively, through the walls thereof substantially along the entire surface areas thereof. Accordingly, the perforations 142, 142A, 142B can be made in any suitable hole size, large or small, where the hole sizes are preferably uniform for each web portion 140, 140A, 140B. The perforations 142, 142A, 142B are provided to dampen outside sound when passing through the door 10, such dampening affect being well known in the sound art.

Accordingly, an elongated fabric material 144, such as a plastic material, a rubber material, a cloth material and the like, is disposed against the inner surfaces of the slats 140, 140A, 140B from the top of the door 10 to the bottom thereof. The fabric material 144 is disposed in the space 110 between the slats 140 and the insulation members 120, as set forth below, to further dampen sounds from the outside of the door 10 as the sounds pass through the door 10, particularly when passing through the perforations 142 in the slats 140. The fabric material 144 also functions to cover and insulate the perforations 142 in the webs 24 of the slats 140.

The assembling of the door 10 shown in FIG. 11 is substantially similar to the procedure described above with respect to FIG. 7, except in this modification thereof, the fabric material 144 has been added thereto. Accordingly, with the slats 140, 140A, 140B connected together in the above-mentioned manner, the fabric material 144 in one continuous length is disposed against the inner surfaces of the slats 140, 140A, 140B. Then, the insulation members 120, 120A, 120B, which as shown need not be filled with the above-mentioned insulation material 104, and which also can or cannot be provided with the above-mentioned inner rear wall 60, 60A, 60B as desired, are installed on the three slats 140,140A, 140B, respectively. The front walls 42 of the insulation members 120, 120A, 120B are disposed against the fabric material 144 so that the fabric material 144 is disposed in the spaces 110 between the front walls 42 and the web portions 24. The fabric material 144 also encircles the hinge barrels 32, 32A, 32B, as shown in FIG. 11.

The insulation member 120 is preferably positioned by the above-mentioned snap-in assembly thereof. Accordingly, as indicated in FIG. 11, the foot portion 52A is first wedged in place against the fabric material 144 disposed adjacent to the flange 26A, and then the hook portion 58A is snapped-over the fabric material 144 covering the hinge barrel 32A at the other end of the slat 12A. The resiliency of the sealing fins 122–132 permits the arcuate wall 48 of the insulation member 120 to receive the hinge arrangement 14 which couples the adjoining slats 12 together, and also for receiving the hinged portions of the adjoining insulation member 120, and the inner rear wall 60 if provided thereon. It is noted, that the resiliency of the sealing fins 120–132 also permits the adjoining slats 140 to pivot relative to each other during the opening and closing of the door 10, in the same manner as indicated in FIG. 8 described above.

Thus, for the most part, the assembling of the door 10 shown in FIG. 11 is substantially the same as shown in FIG. 7 described above, so that a further description thereof is not thought necessary. However, FIG. 11 includes a modified resiliant snap-in portion 166 extending forwardly from the body 64 of the inner rear wall 60, which functions in substantially the same manner as the above-mentioned snap-in portion 66. The snap-in portion 166 includes a pair of diverging leg portions 168, 170 connected to the forward ends of the legs 68, 70, respectively, which extend into converging leg portions 172, 174, respectively, to provide a diamond-shaped arrangement having a pointed free forward end 176 for guiding the snap-in portion 166 into the mouth 106 of the receptacle portion 90 of the insulation member 40 or 120, in the same manner as described above.

Numerous alterations of the structures herein discussed will suggest themselves to those skilled in the art. However, it is to be understood that the present disclosure relates to preferred embodiments of the invention which are for purposes of illustration only, and are not to be construed as a limitation of the invention.

What is claimed is:

1. A roll-up door comprising:

a plurality of elongated adjoining slats;

hinge means for coupling said adjoining slats together for relative movement of said slats between a vertical co-planar arrangement when the door is closed, and an arcuate arrangement when the door is being rolled up;

each of said slats including a U-shaped elongated channel having a web portion interconnecting inwardly directed opposed flange portions, said web portions of said slats cumulatively defining a front face of the door;

distal ends of said opposed flange portions of each slat terminating in forwardly directed arcuately curved first and second segments to define said hinge means;

said first segment on each slat having a curvature substantially concentric with and smaller than a curvature of said second segment on each respective slat;

said smaller first segment defining an elongated hinge pin for insertion into a hinge barrel of an adjoining slat on one side thereof;

said larger second segment defining an elongated hinge barrel for receiving a hinge pin of an adjoining slat on an opposite side thereof;

insertable and removable elongated insulation members being co-extensively disposed along each slat with each insulation member being positioned between said opposed flange portions of each respective slat;

each insulation member being provided with support means for securing said insulation member to an associated one of said slats;

an inner wall being coextensively inserted along a rear surface of each insulation member so that each insulation member is sandwiched between an associated slat on a front side thereof and an associated inner wall on a rear side thereof; and snap-in means for securing each inner wall to an associated one of said insulation members.

2. A roll-up door according to claim 1, wherein said snap-in means includes a pair of spaced apart legs extending forwardly from said inner wall, and an enlarged resiliant snap-in portion connected to forward ends of said legs, said associated one of said insulation members including a receptacle for engagingly receiving said snap-in portion therein to secure said inner wall to said associated one of said insulation members.

3. A roll-up door according to claim 1, wherein each said inner wall is provided with spaced apart recesses, and each said associated one of said insulation members is provided with associated spaced apart recesses for receiving said inner wall recesses therein to additionally secure each said inner wall to each said associated one of said insulation members.

4. A roll-up door according to claim 1, wherein each said inner wall is provided with a hook portion on one longitudinally extending end thereof, said hook portion engaging around a hook portion provided on one longitudinally extending side of each said associated one of said insulation members for securement thereto.

5. A roll-up door according to claim 4, wherein each said inner wall is provided with a lip portion extending outwardly from the opposite longitudinally extending end thereof, said lip portion resiliently engaging against a lip portion provided on the opposite longitudinally extending side of each said associated one of said insulation members for securement thereto.

6. A roll-up door according to claim 1, wherein one side of each insulation member is provided with recess means for accommodating said elongated hinge barrel of its associated adjoining slat, sealing means projecting from an outer surface of said recess means toward said elongated hinge barrel of its associated adjoining slat to prevent air, water, snow and moisture and to dampen any sound from passing through the door.

7. A roll-up door according to claim 1, wherein insulation means are disposed between each of said insulation members and an associated one of said slat web portions to dampen outside sound when passing through the door, said insulation means being an elongated sheet of insulation material.

8. A roll-up door according to claim 7, wherein each of said slat web portions includes numerous perforations therethrough, said perforations having a predetermined size to additionally dampen the outside sound, said sheet of insulation material covering and insulating said perforations.

9. A roll-up door according to claim 1, wherein each slat is fabricated from a metal material, each insulation member is fabricated from a plastic material, and each inner wall is fabricated from a metal material.

10. A roll-up door comprising:

a plurality of elongated adjoining slats;

hinge means for coupling said adjoining slats together for relative movement of said slats between a vertical co-planar arrangement when the door is closed, and an arcuate arrangement when the door is being rolled up;

each of said slats including a U-shaped elongated channel having a web portion interconnecting inwardly directed opposed flange portions, said web portions of said slats cumulatively defining a front face of the door;

distal ends of said opposed flange portions of each slat terminating in forwardly directed arcuately curved first and second segments to define said hinge means;

said first segment on each slat having a curvature substantially concentric with and smaller than a curvature of said second segment on each respective slat;

said smaller first segment defining an elongated hinge pin for insertion into a hinge barrel of an adjoining slat on one side thereof;

said larger second segment defining an elongated hinge barrel for receiving a hinge pin of an adjoining slat on an opposite side thereof; and insertable and removable elongated insulation members being coextensively disposed along each slat with each insulation member being positioned between said opposed flange portions of each respective slat;

each of said insulation members having a thickness from front to rear thereof less than depth of each of said U-shaped slat channels correspondingly from front to rear thereof so that said front of each of said insulation members is in a rearwardly spaced apart relationship to said web portion of each of said slats;

first and second support means on opposing sides of each of said insulation members for suspending each of said insulation members in said rearwardly spaced apart relationship to each of said slat web portions to provide a space therebetween, said space extending from one flange portion of each of said slats to the other flange portion of each of said slats;

insulation means being disposed in said space between each of said insulation members and an associated one of said slat web portions to dampen outside sound when passing through the door; and said insulation means being an elongated sheet of insulation material.

11. A roll-up door according to claim 10, wherein each of said slat web portions includes numerous perforations therethrough, said perforations having a predetermined size to additionally dampen the outside sound; said sheet of insulation material covering and insulating said perforations.

12. A roll-up door according to claim 10, wherein said sheet of insulation material extends from a top slat of the door to a bottom slat of the door.

13. A roll-up door according to claim 10, wherein an inner wall is coextensively inserted along a rear surface of each insulation member, and snap-in means for securing each inner wall to an associated one of said insulation members.

14. A roll-up door according to claim 10, wherein one side of each insulation member is provided with recess means for accommodating said elongated hinge barrel of its associated adjoining slat, sealing means projecting from an outer surface of said recess means toward said elongated hinge barrel of its associated adjoining slat to prevent air, water, snow and moisture and to dampen any sound from passing through the door.

15. A roll-up door comprising:

a plurality of elongated adjoining slats;

hinge means for coupling said adjoining slats together for relative movement of said slats between a vertical co-planar arrangement when the door is closed, and an arcuate arrangement when the door is being rolled up;

each of said slats including a U-shaped elongated channel having a web portion interconnecting inwardly directed opposed flange portions, said web portions of said slats cumulatively defining a front face of the door;

distal ends of said opposed flange portions of each slat terminating in forwardly directed arcuately curved first and second segments to define said hinge means;

said first segment on each slat having a curvature substantially concentric with and smaller than a curvature of said second segment on each respective slat;

said smaller first segment defining an elongated hinge pin for insertion into a hinge barrel of an adjoining slat on one side thereof;

said larger second segment defining an elongated hinge barrel for receiving a hinge pin of an adjoining slat on an opposite side thereof; and insertable and removable elongated insulation members being co-extensively disposed along each slat with each insulation member being positioned between said opposed flange portions of each respective slat;

each of said insulation members having a thickness from front to rear thereof less than depth of each of said U-shaped slat channels correspondingly from front to rear thereof so that said front of each of said insulation members is in a rearwardly spaced apart relationship to said web portion of each of said slats;

a pair of support means on opposing sides of each of said insulation members for suspending each of said insulation members in said rearwardly spaced apart relationship to each of said slat web portions to provide a space therebetween, said space extending from one flange portion of each of said slats to the other flange portion of each of said slats;

one of said support means including an elongated lip resiliently projecting from said rear edge on one side of said insulation member;

said elongated lip being in continuous engagement on the other one of said support means of an adjoining insulation member for suspending said insulation member above said slat web portion of its respective slat;

foot means for wedging against said one flange portion beneath said elongated hinge pin on each respective slat to retain said insulation member in its suspended position along said respective slats;

said foot means including an elongated foot projecting from a front edge on said one side of each insulation member;

said one side of each insulation member being provided with recess means between said lip and said foot for accommodating said elongated hinge barrel of its associated ajoining slat; and sealing means projecting from an outer surface of said recess means toward said elongated hinge barrel of its associated adjoining slat to prevent air, water, snow and moisture and to dampen any sound from passing through the door.

16. A roll-up door according to claim 15, wherein said sealing means are longitudinally extending, spaced apart resilient fins.

17. A roll-up door according to claim 16, wherein said recess means is an arcuate recess having a curvature extending from said foot to be concentric with an arc of rotation of said adjoining slats, said fins extending outwardly from said outer surface of said recess in different lengths with one of said fins adjacent to said foot being the shortest thereof.

18. A roll-up door according to claim 15, wherein an inner wall is coextensively inserted along a rear surface of each insulation member, and snap-in means for securing each inner wall to an associated one of said insulation members.

19. A roll-up door according to claim 15, wherein insulation means are disposed in said space between each of said insulation members and an associated one of said slat web portions to dampen outside sound when passing through the door, said insulation means being an elongated sheet of insulation material.

20. A roll-up door according to claim 19, wherein each of said slat web portions includes numerous perforations therethrough, said perforations having a predetermined size to additionally dampen the outside sound, said sheet of insulation material covering and insulating said perforations.

* * * * *